United States Patent [19]

Drechsel

[11] 4,449,668

[45] May 22, 1984

[54] IMPACT IRRIGATORS IN GENERAL

[76] Inventor: Arno Drechsel, Via Weggenstein, 29-39100 Bolzano, Italy

[21] Appl. No.: 256,193

[22] Filed: Apr. 21, 1981

[30] Foreign Application Priority Data

May 23, 1980 [IT] Italy ..... 46841 A/80

[51] Int. Cl.[3] ..... B05B 3/02; B05B 3/14

[52] U.S. Cl. ..... 239/230; 239/233

[58] Field of Search ..... 239/231, 230, 233, 252, 239/232

[56] References Cited

U.S. PATENT DOCUMENTS

| | | | |
|---|---|---|---|
| 2,649,268 | 8/1953 | Stein | 239/230 |
| 3,559,887 | 2/1971 | Meyer | 239/233 |
| 3,592,388 | 7/1971 | Friedlander | 239/233 |

FOREIGN PATENT DOCUMENTS

| | | | |
|---|---|---|---|
| 3630 | 8/1979 | European Pat. Off. | 239/230 |

*Primary Examiner*—John J. Love
*Assistant Examiner*—Mary F. McCarthy
*Attorney, Agent, or Firm*—Brisebois & Kruger

[57] ABSTRACT

An improved impact irrigator comprising a rapid return device constituted by a deflector disposed at the end of a rocker lever and arranged to be immersed into the jet when in its operating position; the rocking movements of the lever are induced by a linkage controlled by an appendix which, at the end of the outward and return rotations of the irrigator, interferes with two fixed stops; when the rocker lever is in its rest position with the deflector outside the jet, the configuration of the linkage is such as to keep the lever locked in position, so making it insensitive to external stresses; the connection between the linkage and lever is made with a certain slack which enables the lever, when outside its rest position, to rock further through a short distance without changing the configuration of the linkage.

6 Claims, 6 Drawing Figures

IMPACT IRRIGATORS IN GENERAL

This invention relates to improvements in impact irrigators in general, of the type comprising a feed column for the irrigation water, a propelling tube rotatably mounted on said column by way of an adjustable brake; a mobile assembly which swings relative to said propelling tube; return means for said swinging mobile assembly; interchangeable jet breaking means disposed at the front end of the swinging mobile assembly and arranged to interfere cyclically with the jet; a deflector for the rapid return of the propelling tube and provided at the end of a rocker lever pivoted to this latter; and a motion reversal device constituted by a linkage arranged to control the rocking movements of said lever in order to insert and extract the rapid return deflector into and from the jet at the tube outlet.

Said motion reversal linkage is operated by a mobile appendix branching from the propelling tube and arranged to contact movable stops disposed at the top of the irrigation water feed column.

Impact irrigators of known type have certain drawbacks mainly due to the said motion reversal device.

In known irrigators, the rocker lever carrying the rapid return deflector is sensitive to external actions such as casual thrusts or impacts which tend to sink the deflector into the jet, i.e. the relative operating linkage does not oppose said voluntary or involuntary external actions, but it itself influenced by them.

This fact results in a high degree of danger for operators in the act of replacing the nozzle or adjusting the deflector, or merely adjusting the jet breaking means disposed at the end of the swinging mobile assembly, because if the deflector or its lever are inadvertently subjected to slight impact, the deflector sinks into the jet and there is immediate violent rotation of the propelling tube, with consequences for the operator which are immediately apparent.

In this respect, in order to carry out said operations, the operator has of necessity to place himself in proximity to the free end of the propelling tube, and is violently struck thereby.

Summarising, in known irrigators the rapid return deflector besides being operated by the reversal device can also be operated by means of an external casual thrust, with the aforesaid consequences.

Moreover, in known irrigators, the method of operation of the rapid return deflector is such that after it has been partly immersed into the jet by means of its operating linkage, it is completely entrained into the jet and maintained therein by the reaction thereof against a suitable inclined surface.

In known irrigators it happens that if small-diameter nozzles are provided, the partial immersion of the deflector is insufficient to cause it to be completely entrained into the jet by the friction and resistance offered by the linkage operating the rocker lever.

The main object of the present invention is to propose improvements in impact irrigators in general, which remedy the aforesaid drawbacks by means of a simple and rational constructional design.

A first improvement consists of providing, in an impact irrigator of the aforesaid type, a rocker lever operating linkage which carries the rapid return deflector which is configured in such a manner as to make the lever insensitive to voluntary or involuntary external actions directed towards sinking the deflector into the jet, when the lever is in its rest position with the deflector outside the jet.

According to the invention, this is attained in that when the deflector is extracted from the jet, said linkage is caused to assume a stable non-intervention configuration, from which it can be removed only by the operation of its own control appendix.

Said rest or non-intervention position coincides with a configuration of the linkage in which it assumes a stable equilibrium position whatever the force acting on the lever, said configuration being changeable only by acting on the linkage control appendix.

One embodiment of said configuration can be an eccentric device or a crank mechanism of which the rest or non-intervention position is a dead centre position.

Moreover, according to the invention, the transmission of movement between the linkage control appendix and the rocker lever carrying the deflector takes place with a certain slack which enables the rocker lever to move through a certain distance without entraining the entire linkage with it.

The merits and characteristics of the present invention will be more apparent from the detailed description given hereinafter with reference to the figures of the accompanying drawings which illustrate two preferred embodiments thereof by way of example only.

Figure 1:
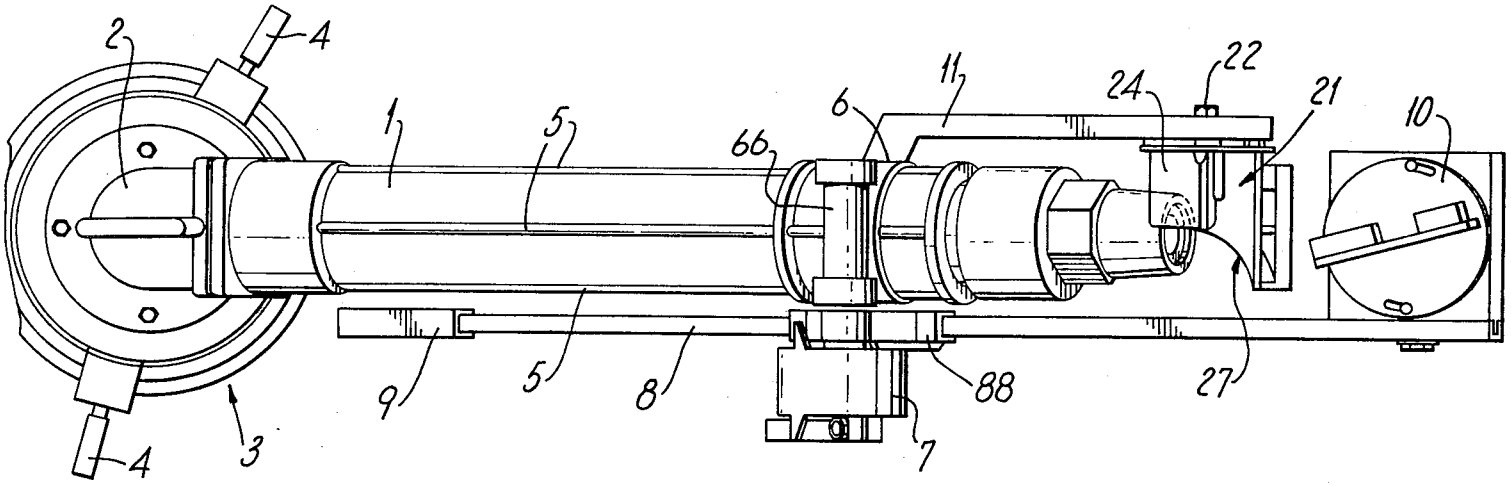
FIG. 1 is an overall plan view of an impact irrigator according to the invention.

Said figures, and in particular FIG. 1, shows a propelling tube 1 which is traversed longitudinally by four radially equidistant longitudinal ribs 5 which ensure correct angular positioning of a clamp 6 relative to said propelling tube 1.

The tube 1 is connected at its rear to an elbow 2, the other end of which is connected by way of a suitable brake 3, adjustable from the outside, to an irrigation water feed column which is not visible in the accompanying figures.

Two stops 4, which can be adjusted angularly, are disposed on the upper circumferential edge of the adjustable brake 3. The clamp 6 carries a shaft 66 which is locked at its top and is disposed transversely to the propelling tube 1.

One of the ends of the shaft 66 extends beyond the lateral limits of the propelling tube 1, where a bracket 88 is rotatably mounted and extends downwards, to lie to the side of the propelling tube 1.

Figure 2:
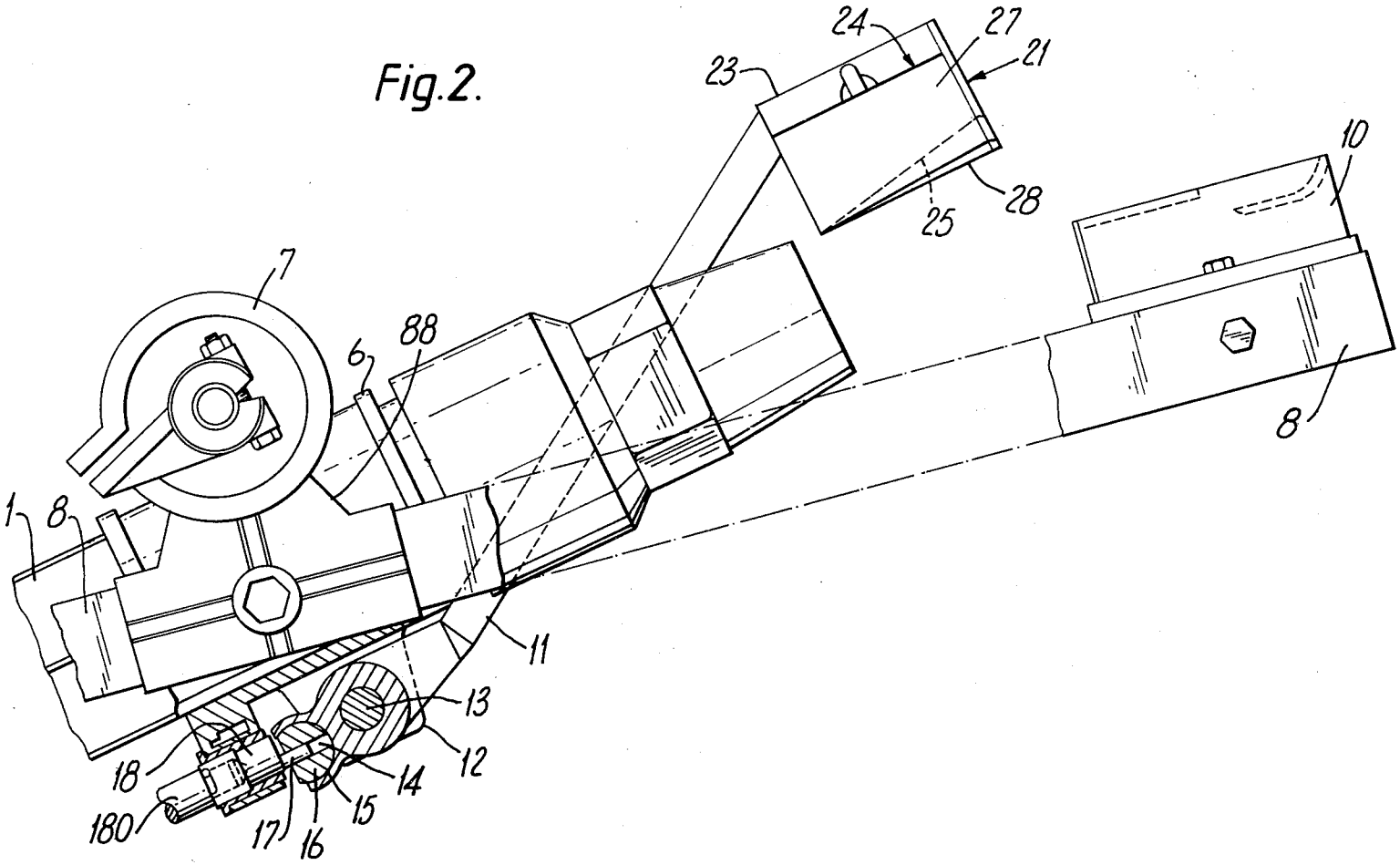
FIGS. 2 and 3 are partly sectional views to an enlarged scale of the front and rear lateral parts of the propelling tube of said irrigator.

As also shown in FIG. 2, the lower end of the bracket 88 is traversed, with possibility of adjustment, by an arm 8 provided at its rear with a counterweight 9.

To the front end of the arm 8 there is fixed a jet-breaking sector 10 of known type, which is arranged to interfere cyclically with the jet leaving the mouth of the propelling tube 1.

Again with reference to said FIG. 1, on the free end of the jutting part of the shaft 66 there is disposed an adjustable torsional brake 7 for adjusting the striking frequency of the jet-breaking sector 10.

The aforesaid elements are not further described as they are of known type.

For example, similar elements are widely described in Italian patent application No. 46 814 A/78.

Referring now to FIGS. 1 and 2 taken together, it will be noted that to the side of the propelling tube 1, and more particularly in the lateral zone of this latter which is opposite that occupied by the swinging arm 8, there is disposed a profiled rocker lever 11, the free end of which extends towards the front zone of the propelling tube 1 so that it involves that portion of the irrigator lying between the jet-breaking sector 10 and the mouth of the propelling tube 1.

A rapid return deflector 21 is cantilever-mounted, by a screw 22 which enables it to be adjusted, on the inner face of the free end of said lever 11.

As can be seen from said figures, said deflector comprises a flat connection part 24 which is orthogonal to the rocking plane of the profiled lever 11, and is practically parallel to the propelling tube 1.

Orthogonal to the free edge of said flat wall 24, and below it, there is provided an arcuate reaction surface 27, the inlet edge of which is parallel to said rocking plane.

From the lower edge of said arcuate reaction surface 27, there branches a full-length lip 28, the thickness of which increases slightly and gradually in moving from the inlet edge of the surface 27 to its outlet edge.

To the rear of the surface 27 and below the flat wall 24 there is disposed a flat reaction surface 25, constituted by an inclined surface which rises increasingly in moving from the mouth of the propelling tube to the jet-breaking sector 10.

On partly inserting the deflector 21 into the jet, the flat reaction surface 25 draws the deflector so that it becomes completely embedded in the jet, and keeps it therein while the arcuate surface 27 generates the tangential thrust which induces the return rotation of the jet.

The irrigator can obviously be fitted with a rapid return deflector different from that represented, provided it comprises reaction surfaces of the same type.

As can be better seen in FIG. 2, the rear end of the profiled lever 11 extends below the propelling tube 1 where it is hinged to a pair of lugs 12 by a pin 13.

To the rear of said hinge, the rocker lever 11 is provided with a seat 15 open towards the rear zone of the propelling tube 1, and in which a cylindrical member 16 parallel to the pin 13 is rotatably mounted.

Figure 4:
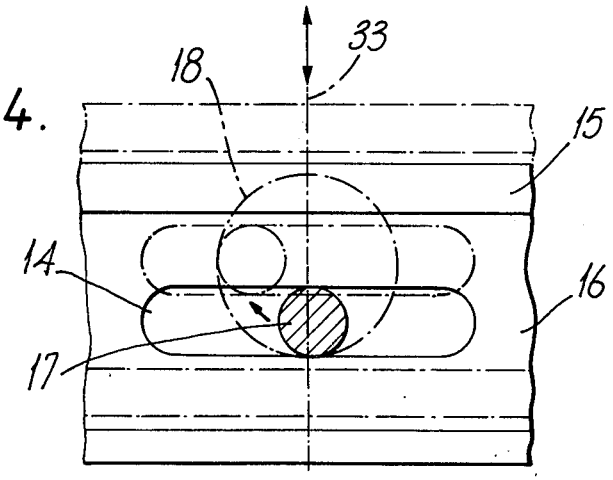
FIG. 4 is a front view to an enlarged scale of a first embodiment of the linkage for controlling the lever carrying the rapid return deflector, already illustrated in FIG. 2.

As can be seen in FIG. 4, the cylindrical member 16 comprises a longitudinal slot 14 in which a cylindrical stem 17 is rotatably and slidably inserted.

In the accompanying FIG. 4, the reference numeral 33 indicates the common plane in which the propelling tube 1 and irrigation water feed column lie.

The cylindrical stem 17 branches frontally in an eccentric position from the front face of a cylindrical member 18 which is torsionally locked, but with a certain degree of slack, at the end of a rod 180 supported rotatably by two suitable supports which branch from the lower generating lines of the propelling tube 1, such that said rod is parallel to the propelling tube 1.

Figure 3:
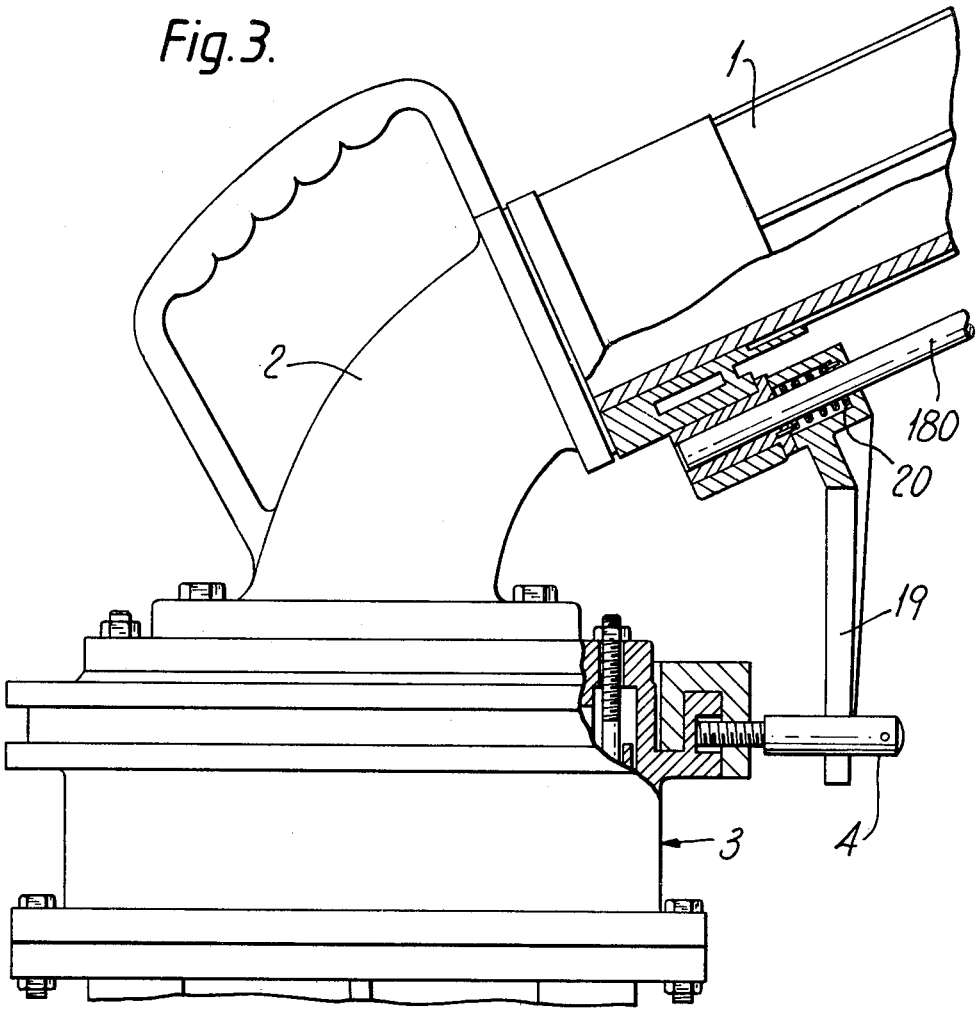

As can be better seen in FIG. 3, to the rear end of the rod 180 there is connected an appendix 19, which extends downwards to reach the level occupied by the stops 4.

Although not shown, to the side of the top of the appendix 19 there are provided opposing stops for limiting the swing, and which are arranged to come alternately into contact with the outer surface of the propelling tube 1.

As can be seen from FIG. 3, at the connection point between the appendix 19 and rod 180, a torsion spring 20 is mounted over the rod 180 and has one end rigid with the appendix 19, whereas its other end is rigid with the rear support of the rod 180.

When the rapid return deflector 21 is outside the jet leaving the propelling tube 1, said torsion spring 20 is in its least loaded position.

When the device according to the invention is irrigating, the outlet jet from the propelling tube 1 is contacted at a certain frequency, in known manner, by the jet-breaking sector 10 so that the propelling tube 1 becomes subjected to a stepwise swinging movement relative to the irrigation water feed column.

Thus during this irrigation, the rapid return deflector 21 is excluded, and the corresponding operating position of the cylindrical stem 17 is shown by a small dashed circle on FIG. 4.

From this latter figure it can be seen that the longitudinal axis of the cylindrical stem 17 is slightly to the side of the common plane 33 in which the propelling tube 1 and irrigation water feed column lie.

At this point, it is apparent that the aforesaid configuration results in a stable position of the cylindrical stem 17 beyond its bottom dead centre, in which the rapid return deflector 21 cannot entrain its actuation linkage with it when urged from the outside.

Said configuration can only be changed by acting on the appendix 19.

Said stable non-intervention position is made substantially possible by the fact that the plane 33 defines for the eccentric linkage constituted by the members 18, 17, 16 and 15, a dead centre from which the stem 17 cannot be removed by acting on the members 21 and 11.

In this manner, the rapid return deflector 21 is reliably prevented from interfering with the jet when this is not desirable, for example when adjusting and replacing the nozzle or jet-breaking sector 10, if inadvertently struck by the operator.

When the propelling tube 1 has terminated its outward stroke, the appendix 19 comes into contact with the stop 4, which causes the rod 180 to rotate.

In this manner, the cylindrical stem 17 is moved from the low position which it occupies in FIGS. 1 and 4 to the high position which is shown in FIG. 4 by a dashed and dotted circumference.

During this rotation, the torsion spring 20 becomes loaded, and the deflector 21 interferes with the outlet jet from the propelling tube, so that it reverses its rotation.

From FIG. 1 it will be seen that the jet is separated into two separate streams, one of which strikes the reaction surface 25 while the other strikes the reaction surface 27.

In this manner, a thrust acts on the first reaction surface which is sufficient to drag the deflector into the jet and to keep it immersed therein, while a thrust acts on the second surface which is sufficient to cause the propelling tube to return to its initial irrigation position.

In said initial position, the appendix 19 makes contact with the other stop 4, and the deflector 21 is extracted from the jet, so initiating a new irrigation stage.

At this point it should be noted that the presence of the torsion spring 20 is an advantage, in that it enables the deflector 21 to be automatically moved from the jet trajectory when feed is stopped to the irrigator.

This prevents the possibility of a person being struck by the propelling tube when the irrigator is again fed.

Furthermore, when the deflector is completely extracted, said spring 20 acts in the sense of keeping the cylindrical stem 17 beyond the dead centre as heretofore defined.

When the deflector begins to enter the jet, the flat reaction surface 25 exerts a force which tends to pull the deflector into complete immersion in the jet, and entraining with it the operating linkage for the lever 11 against the action of the spring 20.

This is facilitated by the gap between the rod 180 and cylindrical member 18, in that the deflector can move downwards through a distance corresponding to said gap without overcoming the resistance of the operating linkage.

Figures 5, 6:
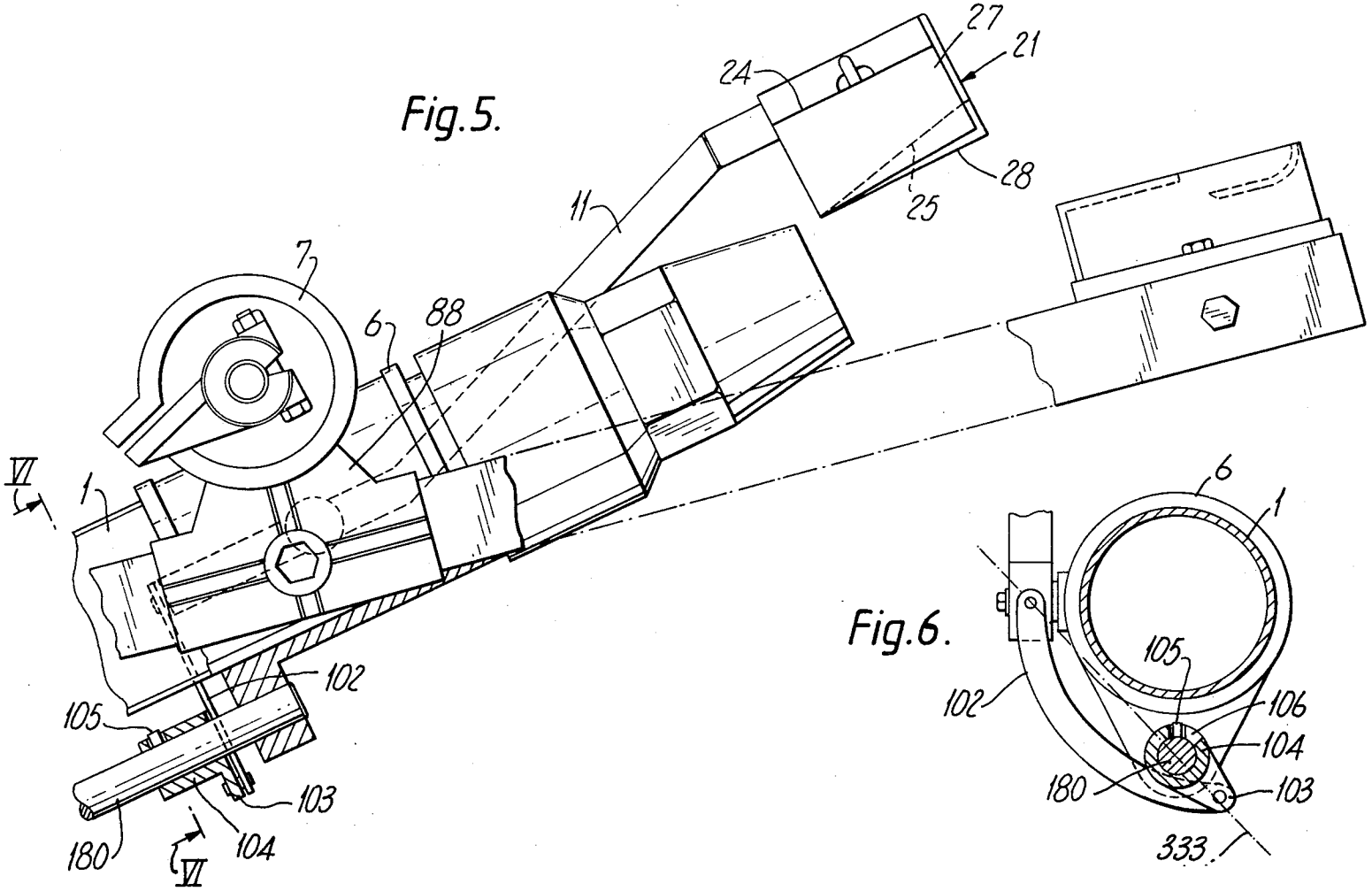
FIG. 5 is a side view similar to that of FIG. 2, of an irrigator with a second embodiment of said linkage.
FIG. 6 is a partial section on the line VI—VI of FIG. 5.

FIGS. 5 and 6 illustrate an alternative embodiment of the operating linkage for the profiled lever 11.

Said figures show that the profiled rocker lever 11 is pivoted at an intermediate point to a bracket 101 branching from the clamp 6.

Below the rear end of the lever 11 there is pivoted a profiled connecting bar 102, which in the example shown is in the form of a circular arc, said connecting bar being disposed in a plane orthogonal to the axis of the propelling tube.

The other end of the connecting bar 102 is pivoted to an arm 103 which branches from a collar 104, this latter being rotatably mounted on the front end of the rod 180.

A radial pin 105 branches from the rod 180 and is inserted into a transverse slot 106 provided in the wall of the collar 104.

The circumferential extension of said slot 106 is less than the maximum rocking stroke which the rod 180 can make in one or other direction.

As can be clearly understood from the accompanying FIG. 6, the described linkage provides a configuration of stable equilibrium, which is attained when the deflector is outside the jet in its rest position, and in which the arm 103 is beyond its own dead centre position defined by the straight line through the three hinges of the eccentric linkage, namely the hinging axis between the lever 11 and connecting bar 102, the axis of the rod 180 and the hinging axis between the connecting bar 102 and arm 103.

Said dead centre position is indicated in FIG. 6 by a dashed and dotted line given the reference numeral 333.

Again with reference to FIG. 6, when the deflector is completely extracted from the jet, the pin 105 rests against the left hand end of the slot 106.

The torsion spring 20 is obviously again provided on the rear end of the rod 180.

It is apparent that the slack or the free path of movement defined by the elements 105 and 106 can also not exist, for example by rigidly connecting the collar 104 to the cylindrical bar 180.

The operation of the eccentric linkage of FIGS. 5 and 6 is as follows.

During the normal stages of irrigation, the deflector is outside the jet, and the linkage is in a stable non-intervention position (FIG. 6) in which the lever 11 and deflector 21 are insensitive to external actions which tend to immerse this latter in the jet.

When the propelling tube 1 reaches the end of its outward stroke, the appendix 19 makes contact with the corresponding stop 4, and after a short idle movement the pin 105 rotates the collar 104 in a right hand direction.

If the irrigator operates at medium and/or high pressure, the collision between said appendix and stop is sufficient to load the spring 20, to move the appendix 19 into its opposite operating position, to cause the hinge between the arm 103 and connecting bar 102 to pass beyond the dead centre 333, and to cause the deflector to become completely immersed in the jet, so that the motion of the propelling tube 1 is reversed.

Furthermore, during said complete immersion, and more precisely when said hinge has passed beyond the dead centre 333, the collar 104 rotates relative to the rod 180, so that the left hand end of the slot 106 again comes into contact with the pin 105.

The aforesaid elements move in the reverse direction when the propelling tube reaches the end of its return stroke, with which a new irrigation stages commences and the linkage returns to the stable non-intervention position of FIG. 6.

The advantageous presence of the slack movement between the pin 105 and slot 106 enables the irrigator to operate properly even when it is fed at low pressure or when it comprises small diameter nozzles.

In this respect, in this case even if the aforesaid force equilibrium should come into play when the deflector is struck by only a small fraction of the jet, the hinge between the arm 103 and the connecting bar 102 has already passed the dead centre 333 so that the small thrust acting downwards on the deflector is sufficient to completely immerse it in the jet.

This is because said slack or idle movement enables the collar 104 to rotate relative to the rod 180 without causing this latter and the other parts of the linkage to rotate.

At this point the jet is completely deviated by the deflector 21, on which there now acts a downward thrust which by way of the elements 11, 102, 103, 104 and 105 is sufficient to move the appendix 19 into the correct position for the return of the propelling tube 1.

The invention is not limited only to the embodiments heretofore described, and modifications and improvements can be made thereto without leaving the scope of the invention idea, the fundamental characteristics of which are summarised in the following claims.

I claim:

1. An improved impact irrigator of the type having an independent deflector for rapid return disposed at the end of a lever controlled by a reversing linkage, to rock between a position in which the deflector is completely outside the jet and a position in which the deflector is completely immersed in the jet for rapid return movement, of the irrigator wherein the reversing linkage which controls the rocking movements of the lever carrying the deflector comprises at least one connecting means movable between a first position in which the deflector is locked outside the jet, and a second position in which the deflector can enter the jet to cause rapid return, said connecting means comprising an element movable over-center to said first position and back through center to said second position, and wherein an inadvertent external force applied to said lever or said deflector tending to move the deflector toward said jet when said connecting means is in said first position acts to more firmly maintain said element in said over-center position and said lever in said first position in which the deflector is locked outside the jet thereby preventing inadvertent and accidental rapid return as a result of engagement of the lever or deflector by an operator working on the irrigator so that possible injury to the operator is avoided.

2. An irrigator as claimed in claim 1, in which said reversing linkage comprises a rod rotatably disposed below the propelling tube and parallel thereto, its rear end being provided with an appendix arranged to make contact with movable stops disposed on the column, its other end comprising said connecting means in the form of an eccentric cylindrical stem which is inserted into a longitudinal slot providing in a cylinder rotatably mounted transversely on the rear end of the rocker lever carrying the deflector, and wherein the two end-of-swing positions of the eccentric cylindrical stem lie on one and the other side of the plane in which the column and the propelling tube lie, and which also corresponds to the plane in which the rapid return deflector swings, so that said over center first position is assumed when the deflector is completely extracted.

3. An irrigator according to claim 2 further comprising limited lost motion in said reversing linkage.

4. An irrigator as claimed in claim 2, further comprising normally unloaded elastic means coupled to the rod of the motion reversal linkage to move the linkage to the position in which the deflector is outside the jet when the jet is inactive.

5. An irrigator as claimed in claim 1, wherein said linkage comprises a profiled connecting bar which is pivoted to a rear end of the rocker lever, said lever is hinged at an intermediate point laterally to the propelling tube, and extends downwardly to below the rod where the lever is hinged to an arm branching from said rod when the deflector is completely extracted from and completely immersed in the jet, the hinging point between said arm and profiled connecting bar occupying two terminal end positions located on one and the other side of the straight line joining the rod axis to the axis of articulation between the rocker lever and profiled connecting bar, so as to give the linkage said over-center first position when the deflector is completely extracted from the jet.

6. An irrigator as claimed in claim 5 wherein slack is obtained in the linkage by providing said arm in one piece with a collar rotatably mounted on the front end of said rod, and in which there is a transverse slot housing a pin extending from the rod; circumferential extend of said transverse slot being less than the complete swing movement of said rod in one direction or the other.

* * * * *